US005515559A

United States Patent [19]

Benson

[11] Patent Number: 5,515,559

[45] Date of Patent: May 14, 1996

[54] CHILD'S SECURITY ENHANCING SLEEPING BAG

[76] Inventor: Maryse O. Benson, 3 Route de St. Mediers, 30700 Montaren, France

[21] Appl. No.: 286,450

[22] Filed: Aug. 5, 1994

[51] Int. Cl.[6] ..... A47C 29/00

[52] U.S. Cl. ..... 5/413; 5/482

[58] Field of Search ..... 5/413, 482, 485, 5/904, 417; 2/69.5; D6/597, 598, 599

[56] References Cited

U.S. PATENT DOCUMENTS

| | | | |
|---|---|---|---|
| D. 160,223 | 9/1950 | Smith | D6/599 |
| D. 252,308 | 7/1979 | Ochwat . | |
| D. 271,071 | 10/1983 | Koether . | |
| D. 289,820 | 5/1987 | Paik et al. . | |
| D. 290,917 | 7/1987 | Rollins, Jr. . | |
| D. 300,681 | 4/1989 | DeMars . | |
| D. 305,844 | 2/1990 | Chang . | |
| D. 311,472 | 10/1990 | Giles | 5/904 |
| D. 328,665 | 8/1992 | McNaughton . | |
| 2,961,668 | 11/1960 | Hayes . | |
| 3,579,675 | 3/1971 | Scheer | D6/598 |
| 3,613,133 | 10/1971 | Isola | 5/482 |
| 3,840,916 | 10/1974 | Jennings . | |
| 4,197,604 | 4/1980 | Nakamura . | |
| 4,236,263 | 12/1980 | Allee . | |
| 4,316,287 | 2/1982 | Rule . | |
| 4,442,558 | 4/1984 | Alexander . | |
| 4,590,633 | 5/1986 | Pickens | 5/413 |
| 4,972,533 | 11/1990 | Brown . | |
| 5,063,912 | 11/1991 | Hughes | 5/904 |
| 5,084,930 | 2/1992 | Danova | 5/482 |
| 5,093,947 | 3/1992 | Henegar et al. . | |

OTHER PUBLICATIONS

United Airlines, "High Street Emporium" Summer, 1994 p. 111, A Bear Hug for Nap Time.

*Primary Examiner*—Flemming Saether
*Attorney, Agent, or Firm*—Dilworth & Barrese

[57] ABSTRACT

A child's sleeping bag is structured to provide a feeling of emotional warmth and security when the child cuddles inside the bag. The bag is configured in the form of a maternal figure, and is made of fabric and soft, resilient filler material to further enhance the feeling of softness and gentleness associated with maternal protectiveness. The opening in the sleeping bag is so positioned that when the child is snugly cuddled in the bag, the child's head essentially rests at the level of the maternal figure's breast. A pillow in the shape of a heart may be provided at the inner side of the figure, on which the child rests his head. The figure is provided with arms circumferential with the opening at the child's neck or shoulder level to further the impression that the child is securely and safely embraced. The figure is provided with a three dimensional head in the form of any one of a number of imaginary animals that are sympathetic and affectionate companions in the child's world. For example, such imaginary animals may include representations of rabbits, mice, bears as well as other animals. The figure's head is tilted away from the sleeping bag's centerline, and is looking off to one side so that the figure's gaze is directed down onto the sleeping child cuddled in its arms. To further emphasize the maternal characteristics of the figure, the figure is attired in typical motherlike fashion; a matronly bodice, a voluminous skirt and an apron.

10 Claims, 2 Drawing Sheets

12
40
32
46
36
14
38
10
44
2
2
28
26
42
30

CHILD' S SECURITY ENHANCING SLEEPING BAG

BACKGROUND OF THE INVENTION

1. Field of the Invention

This invention relates to a child's sleeping bag, and in particular to a sleeping bag structured to provide the child with a feeling of emotional warmth and security.

2. Description Relative to the Prior Art

It is well known that children derive a feeling of comfort and reassurance from contact with soft and yielding fabric articles. The security blanket and cuddling toys readily come to mind as prime examples of devices that are directed towards this strong, universal need of childhood.

In the prior art, sleeping bags have been disclosed for use by children, but they have not been specifically structured to enhance and reinforce feelings of emotional security. For example, U.S. Pat. No. 4,236,263 discloses a sleeping bag where the child crawls into the mouth of a crocodile, and U.S. Pat. No. 4,972,533 describes a combined sleeping bag/comforter in the form of a somewhat undefined creature, where the head of the creature may serve a pillow on which the child rests his head.

SUMMARY OF THE INVENTION

Unlike the prior art, the child's sleeping bag of the present invention is structured to provide a feeling of emotional warmth and security when the child cuddles inside the bag. The bag is configured in the form of a body of a maternal human figure, and is made of fabric filled with soft, resilient filler material to further enhance the feeling of softness and gentleness associated with maternal protectiveness. The opening in the sleeping bag is so positioned that when the child is snugly cuddled in the bag, the child's head essentially rests at the level of the maternal figure's breast. A pillow in the shape of a heart may be provided at the inner side of the figure, on which the child rests his head. The figure is provided with arms circumferential with the opening at the child's neck or shoulder level to further the impression that the child is securely and safely embraced. The figure is provided with a three dimensional head in the form of any one of a number of imaginary animals that are sympathetic and affectionate companions in the child's world. For example, such imaginary animals may include representations of rabbits, mice, bears as well as other animals. The figure's head is tilted away from the sleeping bag's centerline, and is looking off to one side so that the figure's gaze is directed down onto the sleeping child cuddled in its arms. To further emphasize the maternal characteristics of the figure, the figure is attired in typical motherlike fashion; a matronly bodice, a voluminous skirt and an apron.

BRIEF DESCRIPTION OF THE DRAWINGS

The invention will be described with respect to the drawings, of which.

DESCRIPTION OF THE PREFERRED EMBODIMENT

Figure 1:
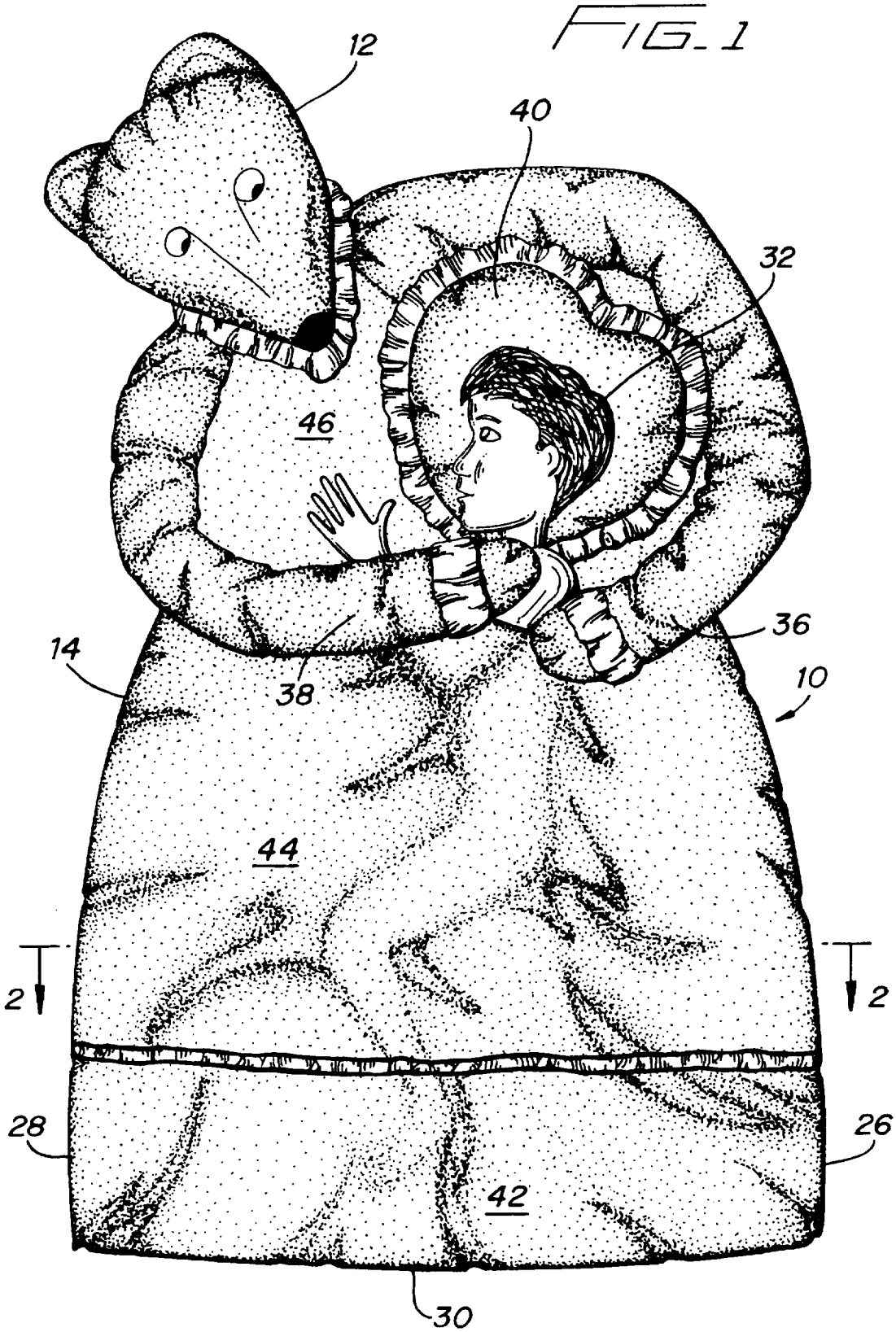
FIG. 1 is a drawing of the sleeping bag in accordance with the invention.
Figure 2:
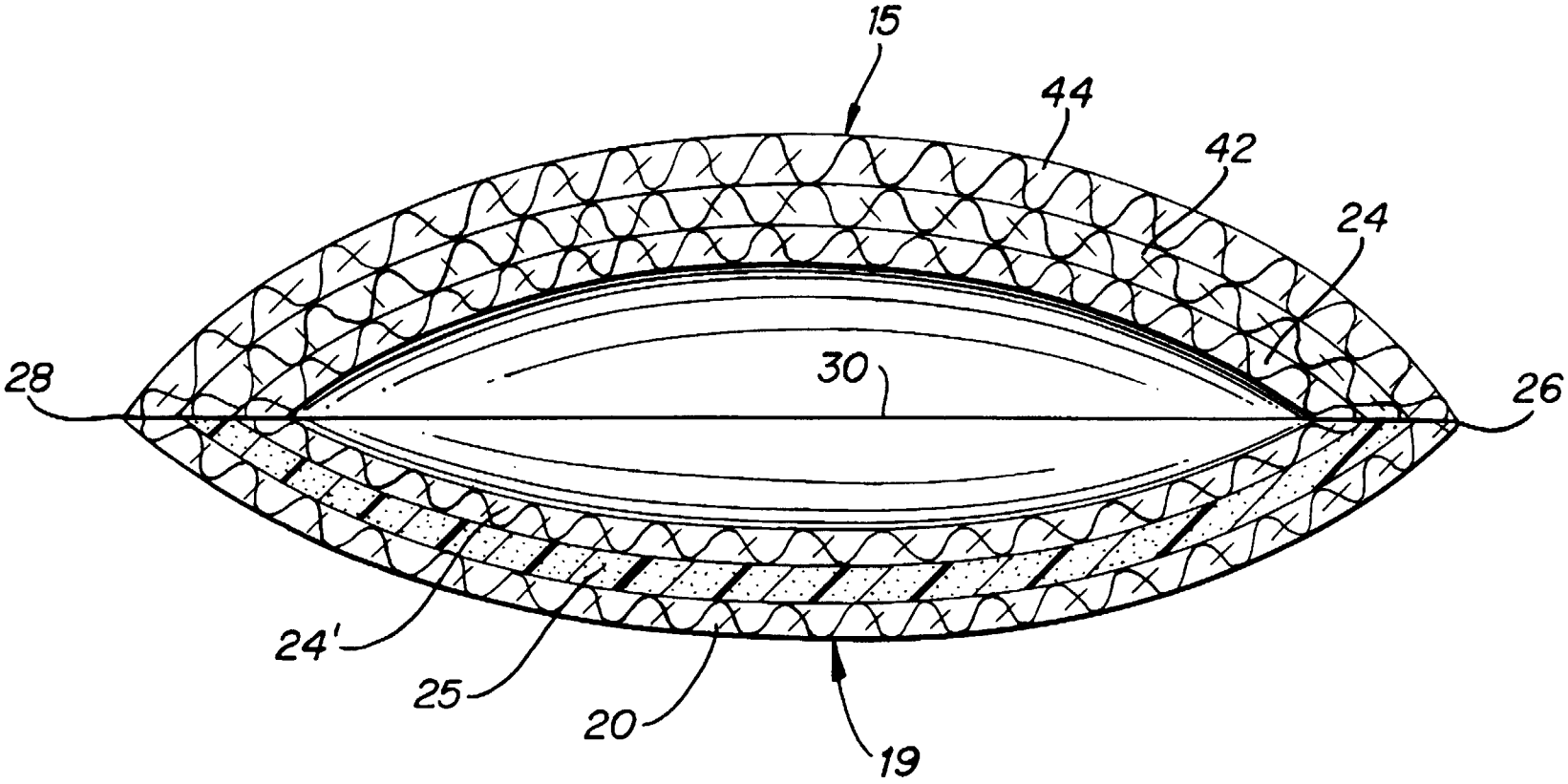
FIG. 2 is a drawing along the section 2—2 of FIG. 1.

As seen in FIG. 1, the sleeping bag 10 is fabricated in the form of a maternal figure having a head 12 and a body 14. Referring to FIG. 2 , which shows the section 2—2 of FIG. 1, the body 14 comprises an upper fabric section 15 consisting of a soft lining 24, fabric skirt 42, and fabric quilted apron 44, and lower fabric section 19 consisting of a soft fabric lining 24' with a layer of filler material 25 sandwiched between the soft fabric lining 24' and a base material 20. The fabrics comprising elements 24, 24', 42, 44 may be of soft, light weight cotton, and the filler 25 may be polyester or cotton. The upper section and lower sections 15, 19 are joined along their side edges to form side seams 26,28 and along their lower edges to form a bottom seam 30 resulting in a bag shaped overall structure. The seams 26,28,30 may either be sewn seams, or may be implemented by fabric edge fastening devices known in the art.

Referring again to FIG. 1, the figure's head 12, is fabricated in a three dimensional form. It is joined to the lower body section 19 at the upper end thereof. The head 12 is tilted off center with respect to the center line of the sleeping bag 10 which extends along an axis of the elongate sleeping bag, with the figure's head gazing towards the position that a child 32 snuggled in the sleeping bag 10 would occupy. Also emanating from the upper portion of the lower section 19, are the figure's arms 36,38 which are fabric cylinders filled with soft filler, i.e. cotton or polyester. The arms 36,38 overlap the upper section 15 of the body 14 to substantially form the opening of the sleeping bag. The arm 36 is attached to the upper section 15 throughout the arm 36 length, while the arm 38 is attached at the figure's shoulder, but is free to move so that the child 32 may grasp it and use it to further embrace him. A pillow 40 in the shape of a heart is attached to the lower section 19 of the sleeping bag 10, and a mechanical or electrical clock-like device with an audible beat may be incorporated into the pillow 40 to simulate the sound of a beating heart.

The FIG. 10 is so attired as to further emphasize its maternal protective aspect. The upper portion of the upper section 15 is configured as a matronly bodice 46, and the lower portion of the upper section 15 is fabricated as a voluminous skirt 42 partially covered by an apron 44.

It will be noted that all elements of the invention are fabric, so that no small, hard or metallic objects can come lose and pose a potential danger of being swallowed by the child. For example, the eyes in the figure's head 12 are not buttons, but are pieces of appropriately colored fabric.

The invention has been described in detail with particular reference to preferred embodiments thereof, but it will be understood that variations and modifications can be effected within the spirit and scope of the invention. For example, a paternal human figure may be readily substituted for the maternal human figure described in detail above.

What is claimed is:

1. A security enhancing sleeping bag comprising:

a) an enclosure of elongate configuration defining a portion of a body of an imaginary character, said enclosure having an entrance for entry thereinto, said enclosure having a head placement portion disposed adjacent said entrance and substantially aligned with a longitudinal axis defined by said enclosure, said head placement portion defining an area to accommodate a head of an occupant of said sleeping bag;

b) a three-dimensional head structure anatomically compatible with said imaginary character and attached to said enclosure proximate said head placement portion and offset from said longitudinal axis of said enclosure so as to lie within view of the occupant of said sleeping bag to impart a sense of security to said occupant, at least a portion of said head structure extending beyond a periphery of said head placement portion; and c) at least one three-dimensional arm structure attached to said enclosure and anatomically compatible with said imaginary character for substantially surrounding said head placement portion of said enclosure to further impart a sense of security to the occupant of said sleeping bag.

2. The security enhancing sleeping bag of claim 1 wherein said head placement portion includes a pillow positioned to accommodate the head of the occupant of the sleeping bag.

3. The security enhancing sleeping bag of claim 2 wherein said pillow is heart shaped in configuration.

4. The security enhancing sleeping bag of claim 1 wherein said head placement portion includes means for producing an audible sleep inducing sound.

5. The security enhancing sleeping bag of claim 4 wherein said audible sleep inducing sound is a heart beat.

6. The security enhancing sleeping bag of claim 1 wherein said body portion of said imaginary character is depicted as being attired in clothing.

7. The security enhancing sleeping bag of claim 1 wherein said at least one arm structure is mounted for movement by said occupant to surround said head placement portion.

8. The security enhancing sleeping bag of claim 1 wherein said imaginary character is female.

9. The security enhancing sleeping bag of claim 1 wherein said head placement portion is adjacent a breast of said imaginary character such that said three-dimensional head structure is above and offset from said head placement portion.

10. The security enhancing sleeping bag of claim 1 wherein said enclosure is formed by an upper fabric structure and a lower fabric structure joined to one another about respective peripheral areas thereof.

* * * * *